US005425596A

United States Patent [19]

Steere et al.

[11] Patent Number: 5,425,596

[45] Date of Patent: Jun. 20, 1995

[54] PAVEMENT MARKER

[75] Inventors: Richard M. Steere, Itasca; Sidney A. Heenan, Park Ridge, both of Ill.

[73] Assignee: Stimsonite Corporation, Niles, Ill.

[21] Appl. No.: 270,245

[22] Filed: Jul. 5, 1994

Related U.S. Application Data

[62] Division of Ser. No. 809,645, Dec. 10, 1991, Pat. No. 5,340,231.

[51] Int. Cl.[6] ..... E01F 11/00; E01F 9/06

[52] U.S. Cl. ..... 404/14

[58] Field of Search ..... 404/12–14, 404/16

[56] References Cited

U.S. PATENT DOCUMENTS 5,255,995 10/1993 Branning ..... 404/14

FOREIGN PATENT DOCUMENTS 2212841 2/1989 United Kingdom ..... 404/14

*Primary Examiner*—William P. Neuder

*Attorney, Agent, or Firm*—Jones, Day, Reavis & Pogue

[57] ABSTRACT

A low-profile housing and lens assembly system for use in a pavement marker. The housing is generally shell like and has a recess for accommodating a retroreflective lens element. The housing is provided with means defining a flat base for providing improved adhesion of the marker to the pavement.

3 Claims, 5 Drawing Sheets

PAVEMENT MARKER

This is a divisional of application Ser. No. 07/809,645 filed on Dec. 10, 1991, now U.S. Pat. No. 5,340,231.

FIELD OF THE INVENTION

The present invention relates to pavement markers of the retroreflector type which are cleaned by the action of vehicle tires passing over the markers and, in particular, to markers having improved retroreflectors and housings.

BACKGROUND OF THE INVENTION

Pavement markers have become widely accepted as permanent installations for providing visible signals which mark traffic lanes and control the flow of traffic on roadways in combination with, or in place of, conventional painted traffic lines. A large number of such markers employ retroreflectors which retroreflect light emanating from oncoming vehicles to provide a signal visible to the operators of such oncoming vehicles.

Exemplary of other pavement markers previously known are those disclosed in U.S. Pat. No. 3,790,293 issued to S. A. Heenan et al., on Feb. 5, 1974, and U.S. Pat. No. 3,809,487, issued to R. M. Flanagan on May 7, 1974, both commonly assigned herewith.

With the advent of the pavement marker disclosed in Heenan U.S. Pat. No. 3,332,327, and since its introduction in 1963, millions of such pavement markers as generally disclosed in that patent have been manufactured and utilized in the "sun belt" states. Subsequent to the development of the '327 patent, various attempts were made to provide a more abrasion-resistant front surface by coating or other protective element, in order to enhance the longevity of the retroreflector element and to make it useful under more rigorous environmental conditions. Attempts have been made to coat the front surface by chemical means (such as disclosed in U.S. Pat. No. 4,753,548).

Applicants' assignee successfully developed a means for applying a micro-thin layer of untempered glass pursuant to the patented process and structure disclosed in U.S. Pat. Nos. 4,232,979, 4,340,319, and 4,596,622, all commonly assigned.

Efforts also were made over an extended period to utilize the basic invention of the U.S. Pat. No. 3,332,327 in "snow belt" states. To that end, after a long succession of efforts, applicants' assignee received, inter alia, U.S. Pat. Nos. 4,195,945 and 4,174,184 covering commercially acceptable devices. The '945 patent issued to S. A. Heenan on Apr. 1, 1980.

Other developments in the retroreflective pavement marker art have included multicellular type structures, in which a plurality of cube-corner type retroreflector elements were isolated by a series of walls around the reflective elements defining "cells". This was done primarily to preserve structural integrity and reflectivity in the event some of the cells were damaged (such as shown in 3M's Holmen U.S. Pat. No. 3,924,929; and also in U.S. Pat. Nos. 4,208,090; 4,227,772; and 4,232,979, the latter all assigned to applicant's assignee).

In the basic structure shown in the '327 patent, the plastic retroreflector elements are first formed as part of the walls of a hollow shell, and then a layer of metal, by vacuum metallization, is deposited on the exposed faces of the cube corner retroreflector elements. Following that step, the "shell" is filled or "potted" with a rigid epoxy-type material. The resulting structure is relatively rigid and over the years has proven to be remarkably durable in use. However, exposure of the metallization to moisture may lead to failure of the retroreflector. Further, because of the diminution in specific intensity of the reflected light (caused by the metallization of the retroreflector elements and distortion during the epoxy filling process, see, for example, Suhr et al U.S. Pat. Nos. 4,070,095 and Attar No. 4,726,706), various attempts have been made over the years to provide what has been known as an "air gap" marker, such as devices disclosed in U.S. Pat. Nos. 4,208,090; 4,227,772; and 4,232,979. While useful as temporary markers, for example during construction, none has been successfully used as a pavement marker installed for an extended time period. Among the reasons are: lack of strength of the housing; poor adhesion of the "hollow" waffle bottom housing to the roadway-when bitumen adhesive is used; and damage to the reflector cell elements.

It also is increasingly a problem in today's economy and under busy traffic conditions to shut down a road for any length of time for installation and for subsequent removal and replacement of pavement markers. Not only is it labor intensive and expensive to do so, but there is a risk of increased accidents when roads are closed or lanes diminished during construction or maintenance. It therefore is highly desirable to have a pavement marker which will have an anticipated life which is longer than that previously expected for pavement markers of the type manufactured in accordance with the U.S. Pat. No. 3,332,327, and which will produce higher initial reflectance.

One advantage of the full epoxy-filled markers is that they provide a textured and flat bottom surface, which makes them readily adherent through either bitumen or epoxy adhesive to any roadway surface. However, it has been observed that when hollow ribbed type markers are used, such as for example the type of temporary roadway marker illustrated in Luckinbill U.S. Design Patent D-267,983, then under certain roadway conditions, particularly on an asphalt roadway and using bitumen adhesive, they are more easily dislodged than an epoxy-filled marker. That is because those hollow "waffle" type ribbed bases tend to act as a "cookie cutter" against the bitumen.

Accordingly, another advantage of the present invention is the ability to employ, in a pavement marker having a thermoplastic hollow base member, means for achieving higher retroreflectivity, by eliminating the metallizing of and potting against reflective elements, while also providing a relatively flat bottom surface to enhance the bond between the installed marker and the underlying roadway surface.

It is a primary object of the present invention to provide a pavement marker having an improved structure for optimum strength and resistance to applied forces as well as providing for an improved retroreflective system enabling the marker to extend its useful life. This is in part accomplished by providing markers on which the initial retroreflective intensity is consistently higher than that achieved from the metalized type marker and in which multiple cells segregating groups of retroreflector elements are also employed so as to prevent damage to any particular cell from propagating into adjacent areas, which will thereby increase the life of the marker as there will continue to be some number of retroreflective elements operational even though some have been damaged and thus the marker will still be usable for extended time periods.

Additionally, it is a primary object of the present invention to provide an improved pavement marker formed of particular materials which will enable it to be used on various pavement surfaces. It has been recognized that, depending upon the nature of the roadway service (asphalt vs. concrete), and upon the nature of the adhesive used to apply a raised pavement marker (bitumen vs. epoxy), the adherence of the marker to the roadway surface may vary dramatically, and so, too, its ability to withstand impact forces without fracturing the marker and/or damaging the underlying road surface.

Therefore, another object of the present invention is to provide a marker having a particular configuration for its base which will enable the marker to be inexpensively and efficiently produced while at the same time providing a new and novel combination of various elements so as to achieve the foregoing objectives.

Yet another object of the present invention is to provide an improved pavement marker which, through the use of certain selected materials, provides enhanced durability. In particular, an important feature of one embodiment of the present invention is that the reflector housing is constructed of a long-fiber-reinforced thermoplastic material having properties which demonstrate superior performance in a variety of environmental conditions from high to low temperatures. The material so used provides improved impact and compression resistance of the reflector assembly, together with excellent abrasion and mar resistance.

Still another object of the present invention is to provide an improved reflector housing having hollow recesses formed by a ribbed structure and filled with epoxy to form a flat bottom surface that is textured for better adherence to a bituminous adhesive and which will have reduced delamination and brittleness failures.

It is also an object of the present invention to provide an improved reflector housing having a flat bottom that extends substantially beyond the periphery of the housing to provide an enlarged base for greater adhesion to the adhesive attaching the housing to the road surface. These advantages of the present invention will be recognized when considered in conjunction with the following detailed description of the drawings and accompanying claims.

SUMMARY OF THE INVENTION

There is provided in the present invention an improved retroreflective lens assembly and housing for pavement markers primarily adapted for use in "sun country" areas. A pavement marker is disclosed for application directly to the road surface or into a groove cut into the road surface.

The pavement markers have a shape designed for optimum strength and resistance to applied forces. The base or housing and the lens assembly configuration are designed to work especially well with more "flexible" pavement surfaces, thus allowing for flexure, but still maintaining adequate strength in elevated temperatures. The base, when produced from acrylic-styrene-acrylonitrile (ASA), is highly weatherable, with good impact resistance and very good color stability. It may be colored to match the lens or other highway markings. Substantially radiused corners are used to minimize tire impact forces and reduce internal stresses. The base ribs are designed for optimum strength while preserving material and providing good flow in the mold. The underside edges along the perimeter of the base have ample radii to restrict cutting through bituminous-type installation adhesives. Teeth or recesses on the bottom of the front and rear edges of the base provide handling advantages and a means to help diffuse adhesive around the edges to avoid the adhesive riding up on the lens assembly. The lens is set deeply into a recess or pocket in the housing with part of the lens brow built into the housing. In this manner, the only way the lens may break out of the pocket in which it sets is straight out, thus providing resistance to flexural forces.

It is still another important feature of the present invention that the lens housing, in which the retroreflector is positioned, is constructed of a long-glass-fiber-reinforced thermoplastic material such as Celstran N 50G from Polymer Composites, Inc. of Winona, Minn., providing improved impact and compression resistance of the pavement marker. Conventional thermoplastics, including those formed with short glass fibers, demonstrate poor impact resistance when formulated for high compressive strength and vice versa. Due to the long glass fibers, of about ½ inch, of these novel materials, both increased impact and compressive strength can be attained, making it ideal for the present application.

A still further important feature is that the front face or lens portion of the retroreflective lens assembly is inclined at an angle which results in reduced abrasive action on the lens. Preferably, this face angle is approximately 35° relative to the roadway surface.

Furthermore, it is intended that the lens assembly of the present markers will incorporate an array of two cube-corner reflective elements surrounded by a wall to define a cell for strength and support. Significantly, it has been determined that this arrangement provides improved retroreflectivity and, accordingly, better visibility of the marker as compared with the use of a single cube-corner element in such a cell.

These advantages are obtained, and it is a general object of the present invention to obtain these advantages, by providing a low-profile pavement marker to provide light reflection visible to an oncoming vehicle.

Many of the design parameters of these improved pavement markers are utilizable in both sun and snow country environments.

BRIEF DESCRIPTION OF THE DRAWINGS

These and other objects of the present invention will be more fully understood in conjunction with the accompanying drawings in which like numbers indicate like components and in which.

DESCRIPTION OF THE PREFERRED EMBODIMENTS

Figure 1:
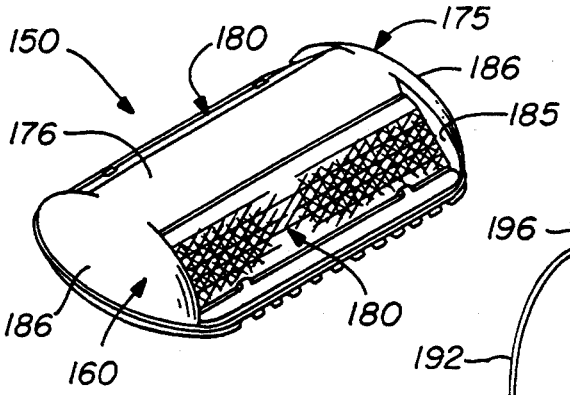
FIG. 1 is a perspective view of an improved partially epoxy-filled pavement marker.
Figure 2:
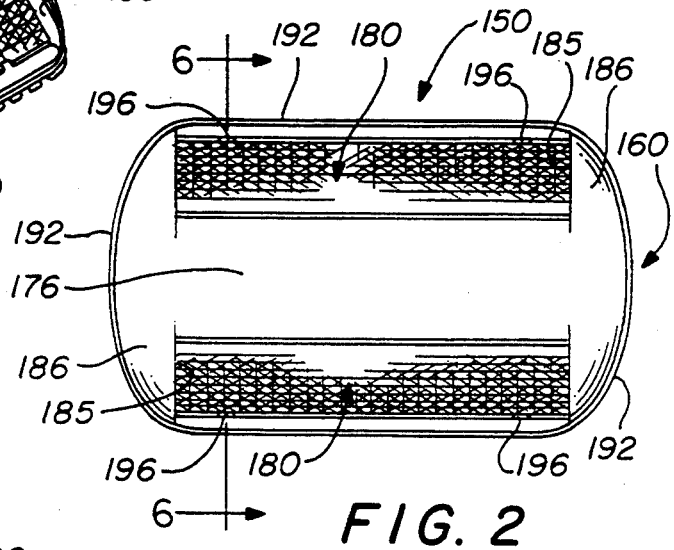
FIG. 2 is a top plan view of the marker shown in FIG. 1.

Referring now to FIGS. 1 through 12, the pavement marker 150 is adapted for use in a sun country where the possibility of impact by snowplow blades is remote at best and which marker can be effectively utilized when it is placed directly on the surface of the roadway (or in a groove in the roadway).

The marker 150 includes a housing 160 and a retroreflective lens assembly 180. The housing 160 is constructed of a first thermoplastic material, such as ASA, and has a substantially hollow ribbed shell having rounded outer ends 186 joining a top wall 176. On the underside, the housing 160 is supported by spaced, integrally formed, depending rib means 172 (see FIGS. 4–6) extending longitudinally of the housing 160 that provide suitable strength while conserving material, providing ease in handling, and enabling good material flow during the molding operation.

A pair of the depending ribs 172 are spaced from a central longitudinal rib 172*a* and all are integrally interconnected along their longitudinal extent by the top wall 176 and spaced transversely disposed ribs 173 into a generally waffle-type appearance, and forming a substantially hollow body while conserving materials but providing substantial resistance to lateral impact and compressive forces as tires roll over the unit, while simultaneously permitting some flexure to conform with irregularities in the roadway with which the marker is to be associated.

Housing 160 includes integrally formed longitudinally extending inclined web members 177 and 178 that terminate in a flat horizontal bottom wall 174 to provide a continuous surface that combines with the remainder of the bottom of the ribs 172 as at 174*a* (FIG. 5) to provide a peripheral bottom wall giving cooperative support when directly engaging or contacting the installation adhesive for securement to the roadway. In the first embodiment, intended to be partially epoxy filled or otherwise based, the internal ribs 172 do not reach the bottom surface. See FIG. 4.

In one embodiment, the hollow body recesses or pockets 175 formed by ribs 172 and 173, web members 177 and 178, top wall 176 and rounded outer ends 186 are filled with an epoxy 175′ well known in the art, to provide a marker that does not suffer from failure and delamination from the roadway and wherein the epoxy is isolated from the retroreflector elements. See FIG. 6. The bottom of the marker, with its exposed epoxy 175′, may be sand covered to provide a flat textured surface 179 to maintain an adequate bond with bituminous adhesives and to provide a type of longer service life for which the marker is designed. The solid and textured bottom surface 179 provides an adequate footprint to resist horizontal forces that could lead to retention problems and avoids the "cookie cutter" result where the prior type hollow ribbed housing tends to cut through the bituminous adhesive. The housing 160 is rigid enough to withstand repeated, short compressive loadings at elevated temperatures while also having good flexural strength for use on flexible asphaltic pavements.

Figure 3:
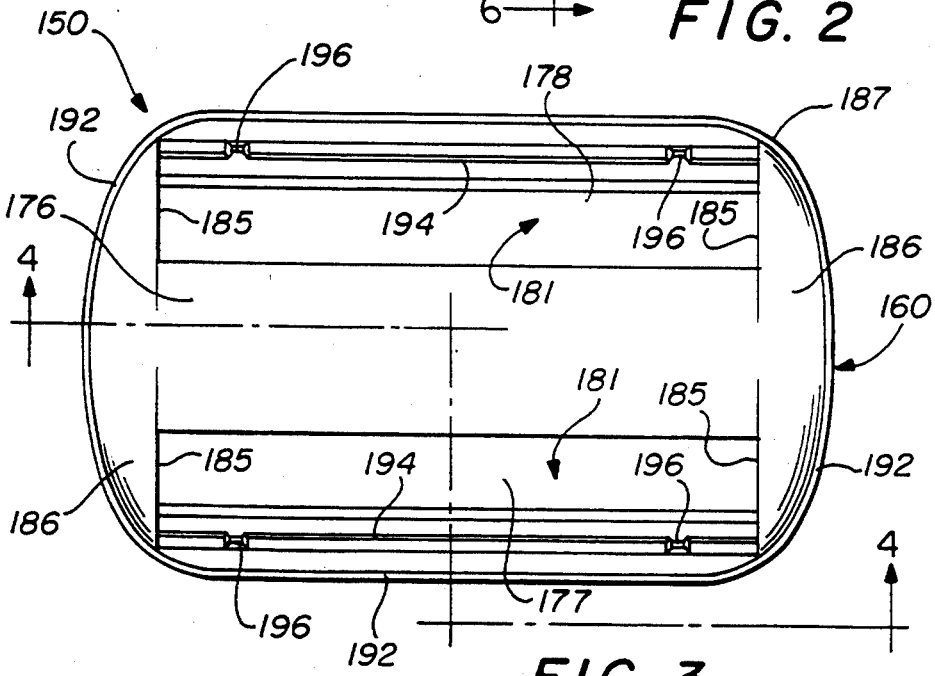
FIG. 3 is an enlarged top plan view of the marker shown in FIG. 2 without the retroreflective lens assembly in position.

Each inclined web member 177 and 178 includes a complementary recess or pocket 181 to accommodate the retroreflective lens 290 or retroreflective lens assembly 180. Each recess 181 includes a rear wall 184 and an inclined upper wall 182 and lower inclined wall 183, the latter walls being substantially perpendicular to the rear wall 184, with only a minor draft angle for molding purposes. The two recesses 181 for accepting the reflective lens assemblies 180 are terminated by flat spaced end walls 185 (FIG. 3). The outer end surfaces 186 of the marker 150 are smoothly curved in three planes and are joined to the straight side walls 185 and top wall 176 by a blended radius slightly above the lens assembly 180 so that an automotive tire will ride over the road marker and the lens assembly will be less subject to impact while still providing access to the lens to be wiped by the rotating tire.

Figure 7:
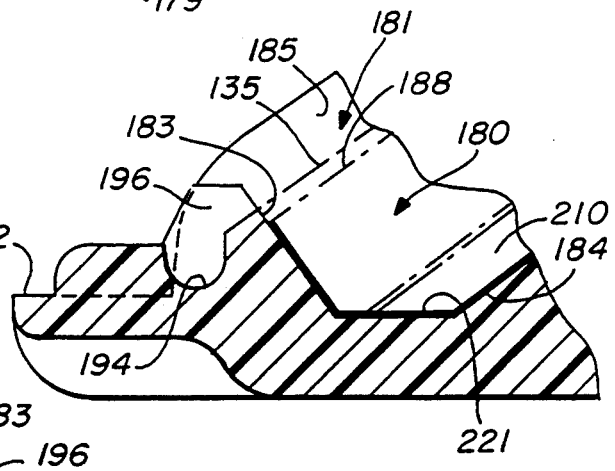
FIG. 7 is an enlarged partial section view of one side of the device shown in FIG. 6.

Referring now to FIGS. 3 and 7, at the upper outermost edge of lower inclined recess wall 183 there is located a continuous groove 194 to accept and retain any adhesive residue (used to hold the lens assembly 180 in the recess or in holding a glass plate 135 to the lens 290), to prevent the residue from blocking the retroreflective action of the lens 290. At least a pair of shouldered tangs 196 are disposed adjacent one edge of the lower recess wall 183 and are adapted to position and assist in retaining a glass covering 135 (FIG. 8) in the appropriate location.

Figure 6:
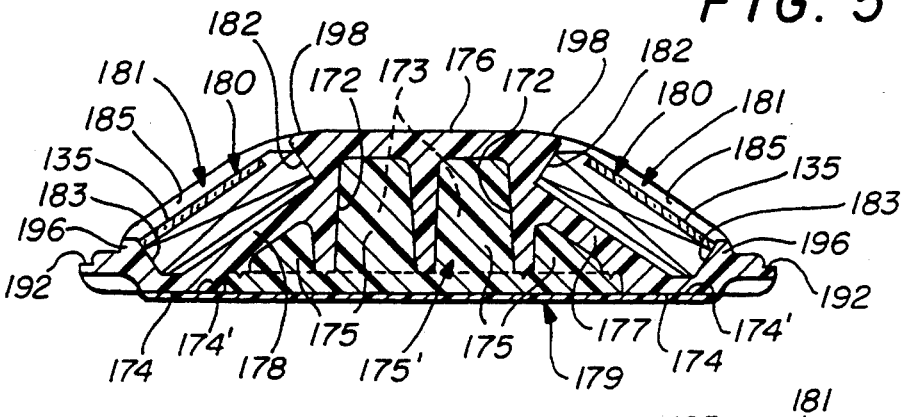
FIG. 6 is a transverse sectional view in elevation taken along line 6—6 of FIG. 3.

As can be seen in FIG. 6, adjacent to the upper wall 182 of the recess 181 there may be located a longitudinally extending groin or overhang 198 that serves to provide housing material to protect the top edge of the lens assembly 180.

Figure 8:
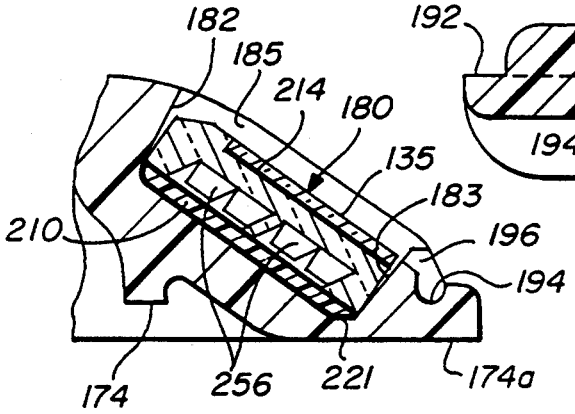
FIG. 8 is a partial sectional elevational schematic view of the preferred form of the lens assembly/-mounted in the housing of the marker.

A schematic representation of one embodiment of a portion of a retroreflective lens assembly 180 is shown in FIG. 8 mounted in a housing 160 similar to the one described. Such retroreflective systems are injection molded from acrylic (or other satisfactory optically acceptable materials) and may have a single retroreflective cube-corner type element per cell or two elements 256 per cell or other appropriate combination of numbers of such retroreflective elements, depending in part on the strength and reflectance characteristics desired. Each lens assembly 180 has a lens 290 and a rear wall or backing member 210. Lens 290 has cell units 204 (FIG. 9) that include a downwardly depending continuous peripheral ridge 200 and similar downwardly depending dividing walls 202 that define each cell 204 and terminate coplanar with ridge 200, for purposes set forth hereinafter.

Where the lens assembly 180 is formed of one thermoplastic material and the housing 160 of another which will not weld to the first, a flat platelike lens backing member 210 (see FIGS. 8, 11 and 12) may be accurately affixed by sonic welding to hold the two elements together at contact of cell walls 200, 202 and 268 (FIG. 9, 10 and 21) with member 210. In this instance the lens 290 with backing 210 will then be adhesively secured to the housing 160.

Figure 9:
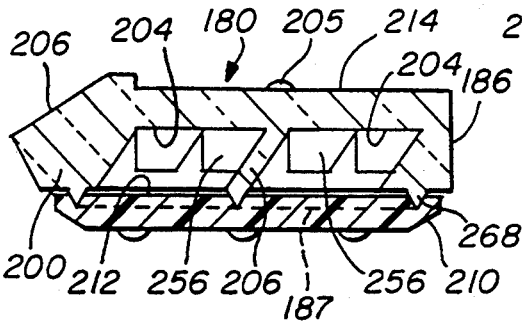
FIG. 9 is a side elevation view in cross sectibn of a retroreflective lens-assembly having two rows of cells.

In FIG. 9 two rows of cells 204 each containing two cube corner retroreflector elements 256 for use in a reflector for a snowplowable marker with a metal casting is illustrated. Such unit is set forth in greater detail in copending application, Ser. No. 805,571, now U.S. Pat. No. 5,277,513, entitled "Snowplowable Pavement Marker" filed on even date herewith and commonly assigned, incorporated herein by reference.

Figure 10:
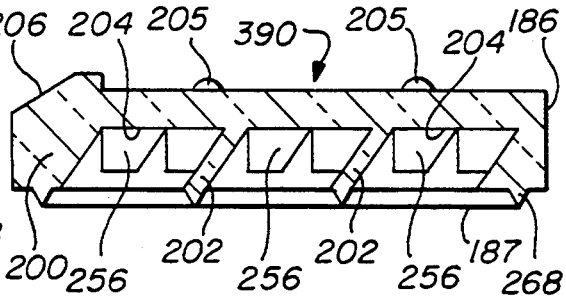
FIG. 10 is a side elevational view, in cross section, of a retroreflective lens having three rows of cells.
Figure 11:
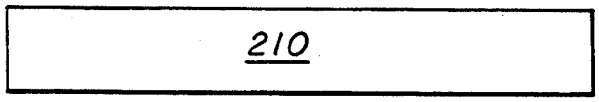
FIGS. 11 and 12 are a top and side view, respectively, of a lens backing for the retroreflective lenses of the type contemplated herein.
Figure 12:
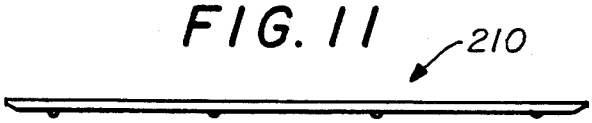

FIG. 10 illustrates a lens 390 for use in a "sun country" marker, having three rows of such double cube-corner retroreflective cells 204. In such event, the nominal design value specific intensity of reflected light from the "sun country" marker should be about 50% greater than that of the "snowplowable" version.

At one edge of each lens 290 in FIG. 8 (or 390 in FIG. 10) there is provided a tapered wall 206 (FIG. 10) that is generally complementary to the groin or overhang 198 of housing 160 as shown in FIG. 6. The wall 206 provides for protection of the upper edge of the glass covering (or the top of the lens, if no glass is used) to minimize chipping or delamination along that edge. The abrasive resistant glass coating 135 may be applied to the face 214 of the lens assembly 180 shown in FIGS. 6, 7 and 8 to improve abrasion resistance.

The lens assembly 180 may be mounted in the recess 181 of the housing 160 by application of an adhesive system 221 (FIG. 7) to withstand impact shocks and retain the assembly 180 in the recess 181. The adhesive 221 may be one of a number of structural adhesives of which, for example, Versilok 406 with accelerator 17, sold by Lord Corporation of Erie, Pa., appears to be satisfactory. While other adhesive systems may prove more than adequate for the purpose of bonding the lens assembly 180 to the housing recess 181, ample tensile strength is required to resist the forces applied through the application of the glass 135. The adhesive 221 is especially suitable for joining two dissimilar thermoplastic materials of different coefficients of thermal expansion.

The lens assembly 180 has a face angle in the range of 30°–45° and preferably of 35° relative to the roadway surface for an optimum balance between abrasion and wiping. The tangs 196 (FIGS. 6, 7 and 8) assist in positioning of the glass 135 during its installation, after the lens assembly 180 is secured to the housing 168. The elongated groove 194 serves as a receptacle for glassing adhesive for the glass 135 and keeps any residue from blocking the retroreflective lens 290. The glass 135 generally may be applied in accordance with the disclosure in U.S. Pat. No. 4,340,319, commonly assigned and incorporated herein by reference. The preheat temperature in this case would be about 150° F. A larger cross-sectional area of the reflective lens. assembly 180 in housing 160 is shown in FIG. 8. A few small protuberances 205 (FIGS. 9 and 10) may be formed on the front face 214 of lens element 290 or 390 to assist in assuring proper adhesive thickness during glass application. The protuberances would overlie the cell walls 202 so as not to interfere with the reflector optics therebelow.

Figure 4:
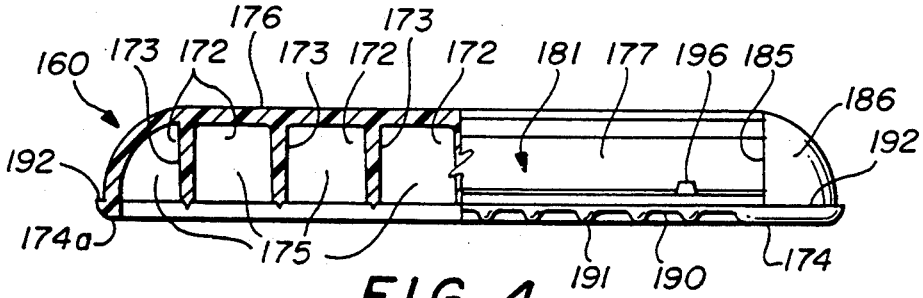
FIG. 4 is a partial sectional elevational view taken along the line 4—4 in FIG. 3.
Figure 5:
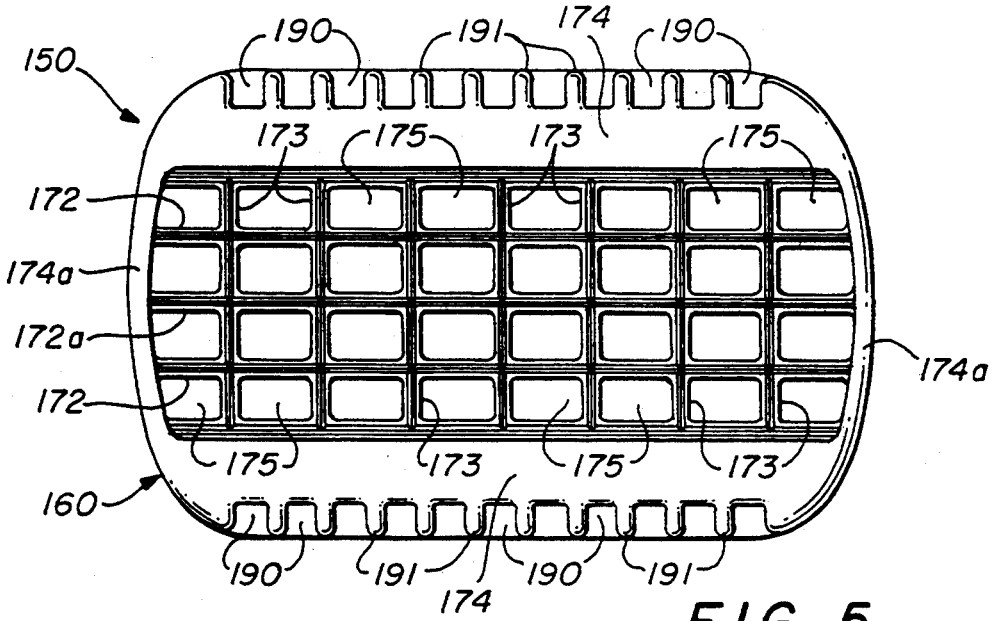
FIG. 5 is a bottom view of the marker housing in FIG. 3, without the epoxy fill.

The housing bottom wall 174 includes a plurality of spaced outwardly and downwardly opening declivities 190 on the outer periphery as shown in FIGS. 4 and 5. On the upper surface of the outer edge of the inclined webs 177 and 178 there is a continuous lip-like flange element 192 facing upwardly. The adhesive utilized to fasten the marker 150 to the pavement surface will engage the declivities 190 and flange 192 to assure retention of the marker in a fixed relation. Further, the declivities 190 provide a "handling" advantage (less likely to slip from one's grasp) and also help to diffuse adhesive around the edges to avoid the probability of adhesive riding up onto the front face of lens 290. An additional technique is to texture at least a portion of the bottom surfaces, i.e. **174*a* and epoxy 175'**, and thereby insure better adhesion. The texture may be EDM finish CHARMILLES No. 36 or equivalent.

Figure 13:
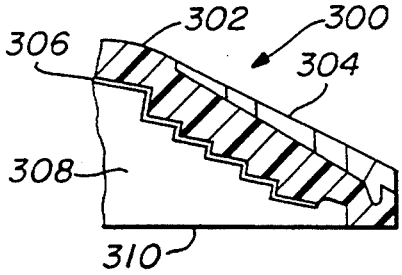
FIG. 13 PRIOR ART
FIG. 13 is a cross-sectional partial elevation view of a metallized potted shell reflector that can be in the prior art.

FIG. 13 illustrates a section of a prior art marker 300 illustrating the shell like body 302 and the retroreflective elements 304 on the inner face thereof with metallization 306 of the cube-corner elements, and epoxy fill 308 in immediate contact with the metallized surfaces 306. The disadvantage of reduced reflectance caused by both metallization and contact of the potting compound with the metallizing is well known. The foregoing novel embodiment of the present invention combines the strength of the epoxy fill—and generally planar bottom surface 310, with the attributes of "air" cell type retroreflectors, with full walls for the cells so as to provide added strength and minimize propagation of damage throughout the entire lens. For example, in the "post" type structure of U.S. Pat. No. 4,070,095, any crack or breakage that admitted dirt below the lens would spread throughout the entire lens and devalue the optics.

Figure 14:
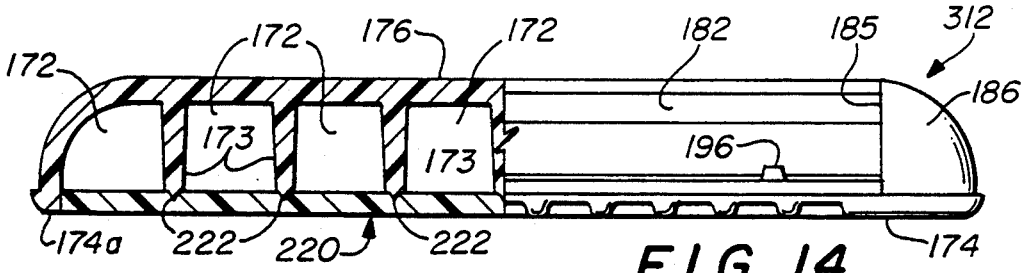
FIGS. 14–16 are various views of an alternate version of the marker using a two-piece housing in lieu of the partial epoxy fill.
Figure 15:
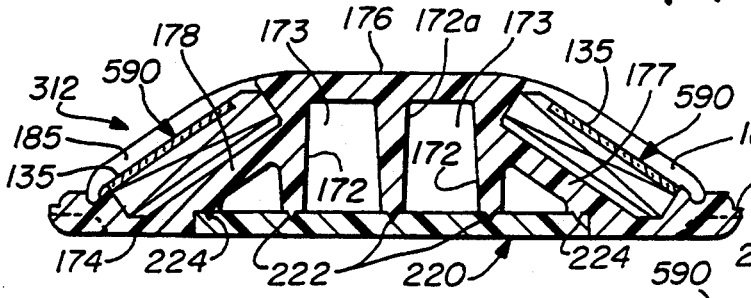

One alternate construction is the marker 412 shown in FIG. 14. The housing construction is generally similar to that illustrated in FIGS. 1 and 2, except that in lieu of filling the housing with epoxy 175' (as in FIG. 6), a bottom plate 220 is fastened, such as by adhesive, sonic welding or other means, to the lower shoulder like edges 224 of the webs 177 and 178 (FIG. 15) and the lower edges 222 of the longitudinal support ribs 172 and the transverse support rib 173. As can be seen in FIG. 14, the cross support ribs 173 and the longitudinal ribs 172 and **172*a* are shorter in vertical length than the webs 177 and 178 by an amount approximately equal to the thickness of the bottom plate 220. A cross-sectional view of this marker is illustrated in FIG. 15 where it can be seen that the plate 220 essentially forms a solid planar surface along with the bottom surfaces 174 of inclined webs 177 and 178. The inclined web members 177 and 178 each have the shoulder-like support surfaces 224 to which the bottom plate 220** is secured.

Figure 16:
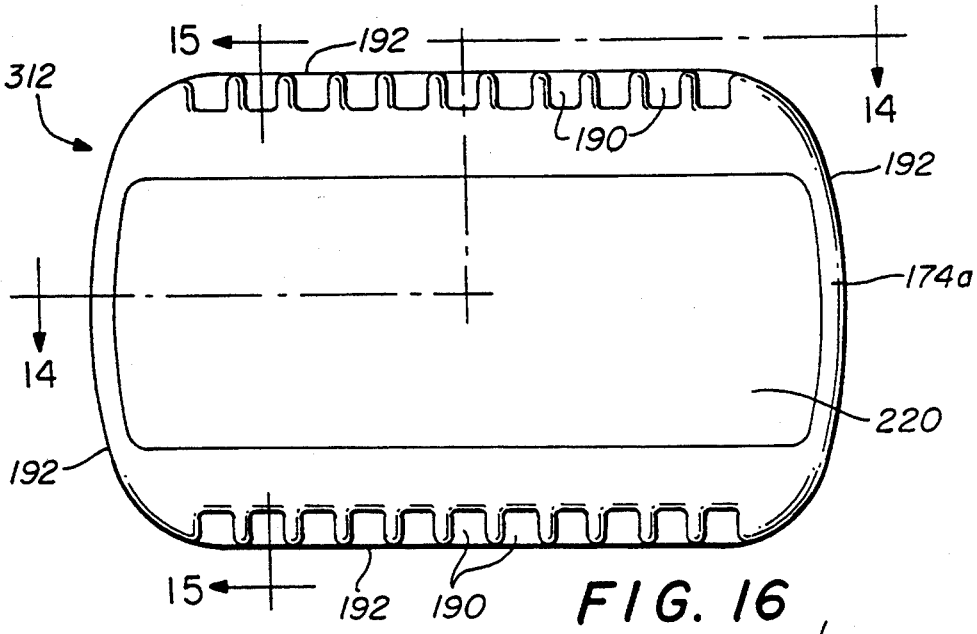
Figure 17:
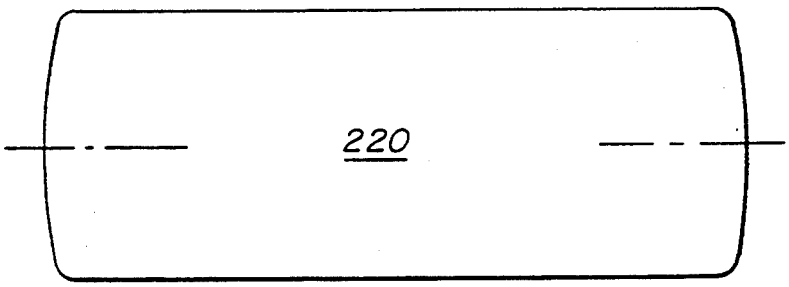
FIGS. 17 and 18 are views of the bottom plate for the construction shown in FIGS. 14–16.
Figure 18:
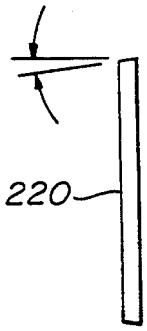

The underside of the marker 412 is shown in FIG. 16 with plate 220 mounted thereon. From FIGS. 14 and 15 it can be seen that the bottom surface 174*a* of end walls 186, the bottom surface 174 of webs 177 and 178 and the bottom of plate 220 are all coterminous with each other and are at the same elevation. Thus, it can be seen that plate 220 rests on shoulder supports 224 of inclined webs 177 and 178 and bottom edges 222 of longitudinal ribs 172, 172*a* and 173. A plan view of plate 220 is shown in FIG. 17 and an end view is shown in FIG. 18.

Figure 19:
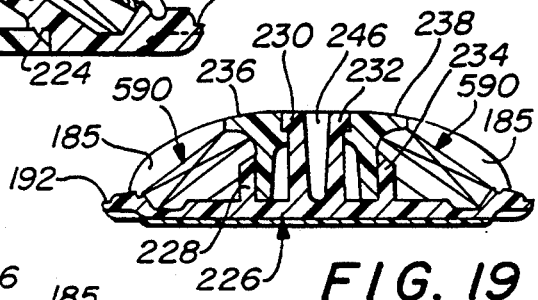
FIGS. 19 and 20 are cross-sectional elevation views of alternate pavement markers.
Figure 20:
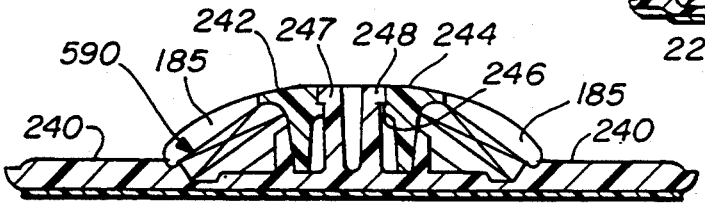

FIGS. 19 and 20 illustrate yet other forms of markers which can be used, having large single unitary formed bottom bases 226 and 240 respectively. In these instances, the base may be molded of a single unitary piece. In FIG. 19, the base 226 may include integrally formed spaced upright vertical supports 230 and 232 having edges 246 which engage snap-in locking housing portions 236 and 238. The snap-in portions 236 and 238 overlay the reflector lens 590.

In like manner, in FIG. 20, the base 240 may have upright supports 247 and 248 again having edges 246 which engage snap-in portions 242 and 244. The base 240 extends substantially beyond the periphery of the housing 160 to form an extended flat bottom surface to be adhered to the pavement.

The embodiments in FIG. 14, 19 and 20 all provide a generally hollow housing 160 for receiving a cellular air gap lens element 590 or lens assembly 180, and also have a solid bottom surface for making exceptionally large area contact with the bituminous (or other adhesive) surface on which they are placed to be able to absorb shock and pressure without damage to the underlying pavement surface on which the marker rests. The bottom plate, along with all other bottom surfaces on other alternatives which do not have a flat bottom plate, may be textured with the CHARMILLES No. 36 or other equivalent texture.

In the preferred embodiment, the bottom plate or surface must be heavily textured to provide greater adhesion to bitumen adhesive and to provide greater resistance to horizontal shear forces. Thus, having a flat plate or solid bottom surface formed with epoxy potting material instead of an exposed rib or waffle pattern increases the contact area which allows for greater load distribution and the "cookie cutter" effect is eliminated.

Samples using a bottom plate like FIG. 14 tested in compression showed no cracks in the housing 160 during loading. Furthermore, no cutting into the bituminous adhesive surface was seen. Without the bottom plate or epoxy potting material, the center core area or the waffle area cut into the bitumen. The loading causes the bituminous material to be forced into the cores or recesses 175 of the housing 168 while the perimeter of the marker deflects upwardly because the reaction forces are not restrained at the boundaries. This situation causes enough downward deflection through the marker center leading to crack propagation and potential loss of bond to the pavement.

Also, the lip 192 around the outward periphery of the housing is effective in causing the marker to adhere to the pavement. Use of either epoxy or bituminous adhesive achieved the same results. Ample puddles of either adhesive will flow around the lip 192 to improve the bond between the marker and the associated pavement surface.

Figure 21:
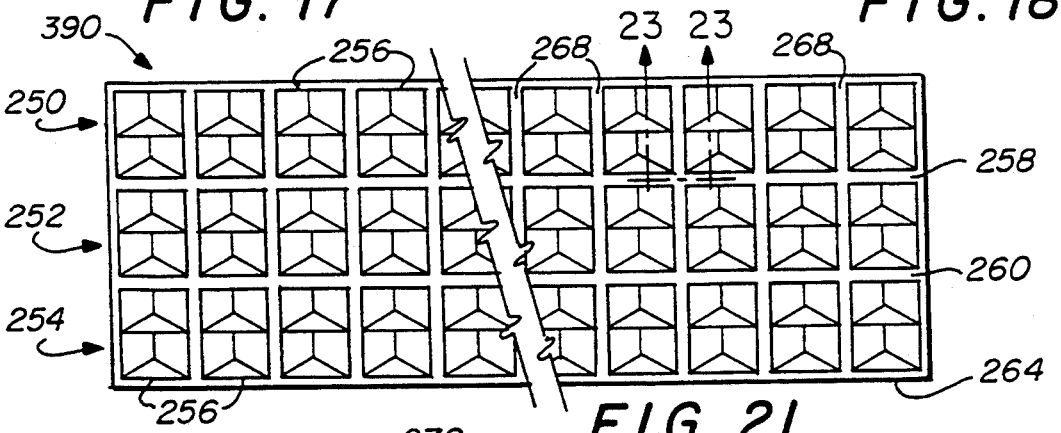
FIG. 21 is a view of one embodiment of the novel lens assembly of the present invention taken normal to the front face.

A front face view of the preferred embodiment of the lens 390 is illustrated in FIG. 21. As can be seen, the unit consists of three rows 250, 252, and 254 of cells in a plurality of columns, each cell having two retroreflective cube-corner elements 256 formed therein. In this unit, there are 27 columns preferred, but the number may vary with the width of the lens 290 and the width (or thickness) of the walls 268 between columns. By placing the cells in rows and columns separated by horizontal walls 258 and 260 and vertical walls 268, if damage occurs, desirably it will affect only those cells specifically damaged and should not propagate to other cells. The rectangular double cube-corner retroreflective lens formed such as illustrated in FIG. 21 gives superior performance. The vertical walls 268 are ½ the thickness of the horizontal walls 258 and 260, as it has been found that crack damage is more likely to run vertically than horizontally. For clarity, it should be understood that these walls dividing the cells are essentially the same as designated 202 in FIG. 10, where the lower end of each such wall is adhered to plate 210.

Figure 22:
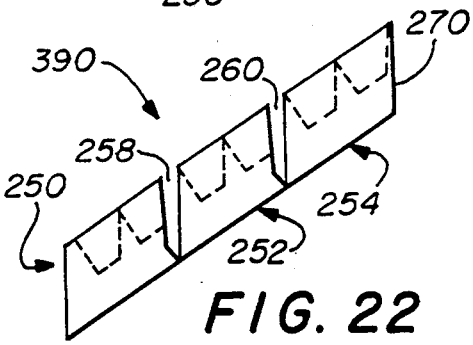
FIG. 22 is a partial end view of the lens assembly illustrated in FIG. 21.
Figure 24:
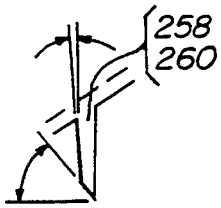
FIG. 24 is a detailed view of the walls separating rows of the cells.

FIG. 22 is a partial end view of the lens 390 illustrated in FIG. 21. The three rows of cells 250, 252, and 254 can be seen to be separated by walls 258 and 260. The details of these walls are illustrated in FIG. 24. They are approximately 0.023 inch at the top thereof and are 0.135 inch deep. The distance from the back surface 264 to the first wall 260 is about 0.15 inch and the distance to the center of the second wall is about 0.302 inch. The distance from the bottom of the first wall 260 to the tip 266 of the lowest portion of the lens 390 is about 0.152 inch, while the distance from the base of the second wall 258 to the lowest point 266 of the assembly 180 is 0.415 inch. The nominal design specific intensity for this lens, in crystal, at 0.2° observation angle and zero degree entrance angle, is 8.0 candelas per foot candle.

Figure 23:
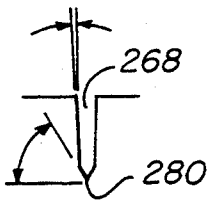
FIG. 23 is a detailed view of the walls in the lens assembly that separate the columns of retroreflective elements in the cells.

FIG. 23 is a view taken along lines 23—23 of FIG. 21 and is a detailed view of the walls which separate the columns of cells from each other. The lowest portion 280 of wall 268 is angled on both sides at substantially 60°. The bottom has a radius of 0.003 inch maximum. The upper portion of wall 268 has a width of 0.018 inch. The sides of the slot 262 have a 2° draft on each side for molding purposes.

Figure 25:
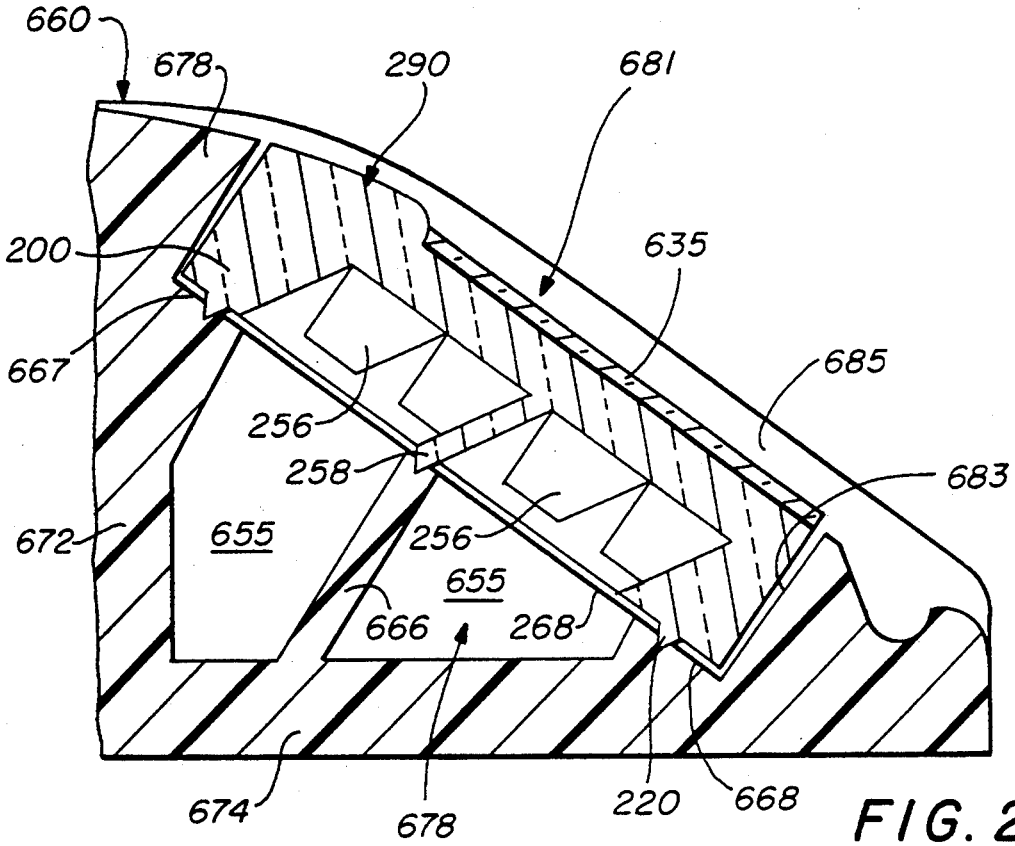
FIG. 25 is a view similar to FIG. 8, in which yet a slightly further modified version of the pavement marker housing is illustrated.

FIG. 25 is yet another housing (half view along center line) which also is a relatively hollow shell like structure 660 which may be provided with the downwardly extending longitudinal (672) and lateral (678) ribs; unlike the prior versions, there are two distinct differences.

First, the bottom surface 674 below the inclined wall member 678 provides a unitary bottom wall entirely encompassing the area formed by said peripheral bottom wall which eliminates the need for epoxy 175' or a separate bottom plate 220.

Second, in this embodiment, the web or wall 678 which extends transversely to the housing 660, has a main recess 681 therein, like recess 181, but the inclined wall 678 is subdivided into a plurality of vertically directed walls (such as 655) by a longitudinally extending wall 666 inclining upwardly from the extended bottom wall 674 thereby dividing the web into plural open cells, the walls 655 being formed to be in alignment with the columnar walls 268 of the lens element 290 to provide support for the lens, without impeding or impacting any of the cube corner reflector elements 256 on the reverse side of the lens. Further, the inclined walls 666 engage and support the walls 258 separating rows of cube corner reflector elements.

Figure 26:
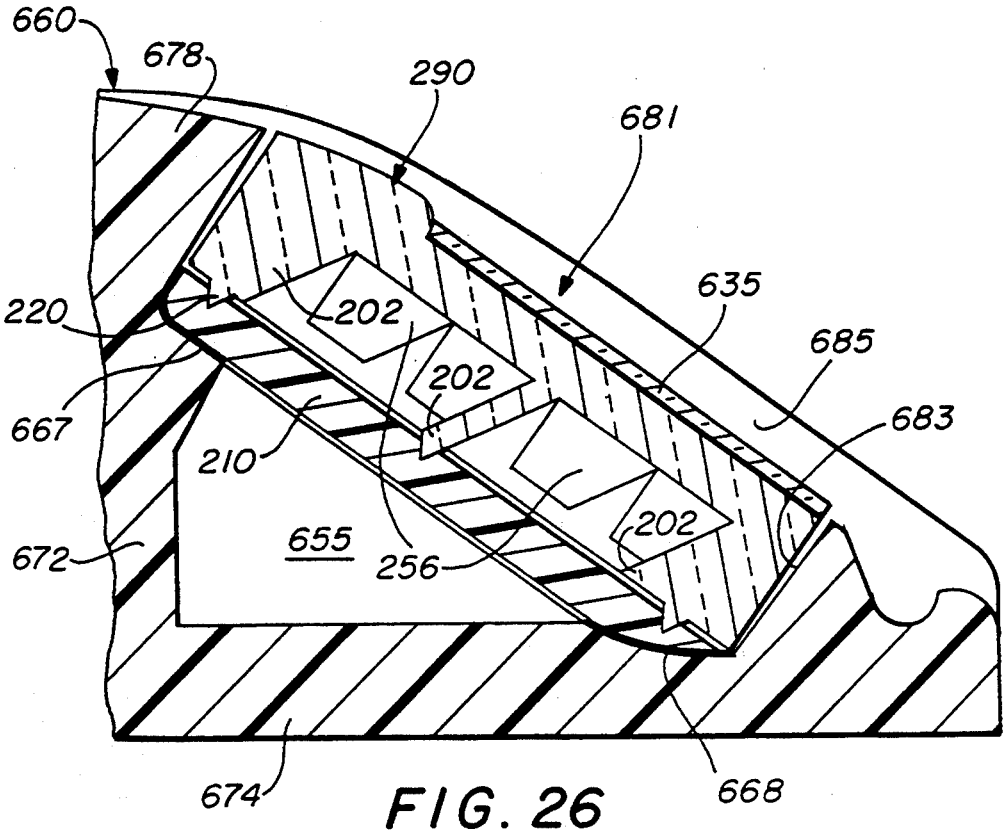
FIG. 26 is a view similar to FIG. 25, with yet a further modified housing and lens arrangement.

The housing 660 in the embodiments of FIGS. 25 and 26 are essentially identical, except for the longitudinal inclined rib 666 in the FIG. 25 embodiment which must be aligned with horizontal dividing wall 258 when the lens element 290 is affixed directly within the recess 681 without the backing plate 210. The FIG. 26 embodiment need not be provided with the longitudinally inclined rib 666 because the lens element 290 is provided with the backing plate 210 that is supported by the laterally inclined walls 678.

With either of the embodiments of FIGS. 25 and 26, the length in the travel direction may be made somewhat shorter, or alternatively the housing could be extended beyond the lens element. In these embodiments, the cell walls 258 and 268 for the lens element may be provided support directly by the ribs 655, 666 within the recess formed within the webs 678.

The advantages of the housings of FIGS. 25 and 26, is the elimination of a separate "potting" step and/or the addition of a large bottom plate. Here the enlarged bottom surfaces 674 will be molded as part of the housing 660 with any difficulty in molding such solid areas being compensated for by providing the cellular structure on the web wall. In yet a further option, not illustrated, the cell dividing walls could be provided directly on the lens backing plate 210 itself rather than as at 202 on the lens element 290.

From the foregoing, it can be seen that there has been provided a novel and improved pavement marker.

Further improvements that have been disclosed include a restraining means to assist in retention of the lens assembly in the recesses of the housing means and groove means for retention of excess adhesive means so that such adhesive does not coat or interfere with the proper operation of the lens assembly. The molded housing further includes rounded surfaces that will deflect impact forces, the housing being molded of very weatherable materials with excellent abrasion and mar resistance. The hollow ribbed housing construction is designed to not only conserve on materials but also to work especially well with flexible asphaltic pavement surfaces, allowing for flexure, while maintaining strength in elevated temperatures. Superior performance is obtained from a partially epoxy-filled marker for support of the ribbed structure. A rough textured bottom surface assists in adhering the marker to the bitumen with the adhesive and in resisting shear forces.

In the embodiment for sun country use, the housing may be formed of a first thermoplastic, such as acrylic-styrene-acrylonitrile from Monsanto Chemical Co., while the lens is formed of a second thermoplastic, such as a modified acrylic, MI-7 from Rohm & Haas.

In the sun country version, the width of the housing is about 4.50 inch; the length (in the direction of travel) is about 2.75 inch; and the height of the housing from top to bottom is about 0.625 inch.

In the snowplowable version, the housing is formed of Celstran N50G from Polymer Composites. The long glass fiber would be about 0.5 inch long. It will be understood that this housing is more durable and more costly, but if desired the long fiber thermoplastic housing could be used for sun country markers as well.

While there have been described what are at present considered to be the preferred embodiments of the invention, it will be understood that various modifications may be made therein, and it is intended to cover in the appended claims all such modifications as fall within the true spirit and scope of the invention.

We claim:

1. A pavement marker comprising:

a solid flat plate having at least one rib extending vertically upwardly from the top side thereof;

a recess member formed on the top side of said plate on at least one side of and spaced from said vertically extending rib;

a retroreflective lens member being .i supported by one side at least recess member and positioned at an angle of approximately 35° relative to said flat plate; and a latching member disposed between said lens member and said vertically extending rib for locking said lens member in said at least one recess on said plate thereby providing a housing and lens having said flat base plate as a base for adherence to a pavement.

2. The pavement marker as in claim 1 wherein said flat bottom plate extends substantially beyond the edges of each of said lens assemblies to form an enlarged bottom plate for adherence to said pavement.

3. The pavement marker as in claim 2 wherein:

said vertically extending rib has a horizontal projection extending outwardly from each side of the upper end thereof; and each said latch members has a corresponding lip for fitting under and engaging the horizontal projection on each side of the vertical rib for latching purposes and has an outer projection extending partially over said lens member to hold said lens member in locked relationship to said base in said recess.

* * * * *